United States Patent [19]

Tsumadori et al.

[11] Patent Number: 4,795,573

[45] Date of Patent: Jan. 3, 1989

[54] FABRIC SOFTENER OF MIXED QUATERNARY AMMONIUM SALTS: COMBINATION OF LINEAR ALKYL AND METHYL-BRANCHED ALKYL QUATERNARY AMMONIUM SALTS

[75] Inventors: Masaki Tsumadori; Junichi Inokoshi, both of Utsunomiya, Japan

[73] Assignee: Kao Corporation, Tokyo, Japan

[21] Appl. No.: 938,953

[22] Filed: Dec. 8, 1986

[30] Foreign Application Priority Data

Dec. 16, 1985 [JP] Japan ..... 60-282677

[51] Int. Cl.[4] ..... C11D 1/64; D06M 13/46

[52] U.S. Cl. ..... 252/8.8; 252/8.6; 252/8.9

[58] Field of Search ..... 252/8.8, 8.9

[56] References Cited

U.S. PATENT DOCUMENTS

| | | | |
|---|---|---|---|
| 3,395,100 | 7/1968 | Fisher et al. | 252/8.8 |
| 3,803,137 | 4/1974 | Egan et al. | 252/8.8 |
| 3,892,669 | 7/1975 | Rapisarda et al. | 252/8.75 |
| 4,098,822 | 7/1978 | Egan et al. | 252/8.8 |
| 4,214,998 | 7/1980 | Joy | 252/8.8 |
| 4,341,644 | 7/1982 | Bisschops et al. | 252/8.8 |

FOREIGN PATENT DOCUMENTS

| | | |
|---|---|---|
| 2625945 | 2/1977 | Fed. Rep. of Germany . |
| 58-144174 | 8/1983 | Japan . |
| 1390267 | 4/1975 | United Kingdom . |
| 1397507 | 6/1975 | United Kingdom . |
| 1451998 | 10/1976 | United Kingdom . |
| 2015051 | 9/1979 | United Kingdom . |

*Primary Examiner*—A. Lionel Clingman

*Attorney, Agent, or Firm*—Oblon, Fisher, Spivak, McClelland & Maier

[57] ABSTRACT

A novel softener comprises (A) linear alkyl quaternary ammonium salt and (B) methyl-branched alkyl quaternary ammonium salt, the ratio of (A) to (B) being 70/30 to 10/90 by weight.

The softener imparts softness, antistatic property and water absorbency to a variety of fibers.

6 Claims, No Drawings

FABRIC SOFTENER OF MIXED QUATERNARY AMMONIUM SALTS: COMBINATION OF LINEAR ALKYL AND METHYL-BRANCHED ALKYL QUATERNARY AMMONIUM SALTS

BACKGROUND OF THE INVENTION

1. Field of the Invention

The present invention relates to a softener, and more particularly it relates to a softener which imparts improved softness, antistatic property, and water absorbency to a variety of fibers.

2. Description of the Prior Art

Clothes often exhibit poor handleability after repeated wearing and washing because the fiber loses the finishing agent and gets harsh due to the deterioration of fiber itself. For this reason, softeners have come into common use in the home in order to impart softness and antistatic property to fibers.

The commercial softeners for household use are mostly ones which are composed mainly of a cationic surfactant having one or two long-chain alkyl groups in one molecule, particularly one which is composed mainly of di(hydrogenated tallow alkyl)dimethylammonium salt.

This quaternary ammonium salt, even in a small quantity, imparts good softness and antistatic property to a variety of fibers. It produces the softening effect because the lipophilic moiety of the molecule adsorbed to the fiber surface produces the lubricating effect, reducing the coefficient of friction of the fiber surface. Therefore, it is considered that the lipophilic property is indispensable for the good softening effect. On the other hand, the lipophilic property has a shortcoming of making treated clothes water-repellent and lowering the water absorbency of treated clothes. Decrease in water abosorbency is remarkable especially in the case where the concentration of softener is high.

Consequently, studies have been made on the improvement of water absorbency, and some compounds have been found effective. They include a branched alkyl quaternary ammonium salt [as disclosed in U.S. Pat. Nos. 3,377,382 and 3,395,100] and an imidazolium compound derived from oleic acid [as reported in Journal of American Oil Chemical Society (JAOCS), 61, 367 (1984)]. These compounds are certainly effective in the improvement of water absorbency; however, on the other hand, they are poor in softening effect and are apparently inferior to the above-mentioned di(hydrogenated tallow alkyl)dimethyl quaternary ammonium salt. For the reinforcement of softening effect, the imidazolium compound is usually used in combination with distearyldimethylammonium chloride or an imidazolium compound derived from hydrogenated tallow fatty acid. The combined use, however, does not provide satisfactory water absorbency. In the case of $\alpha$- or $\beta$-branched alkyl quaternary ammonium salt, the problem is solved by the combined use with a linear alkyl quaternary ammonium salt (see Japanese patent application Laid-open Nos. 69998/1974, 53694/1975, 122207/1979, and 144174/1983; U.S. Pat. No. 3,892,669; and West Germany Pat. No. 2625945). None of the above-mentioned prior art, however, provide satisfactory softening effect.

SUMMARY OF THE INVENTION

With the foregoing in mind, the present inventors carried out earnest studies in search of a new softener which has good softening performance and yet does not impair the water absorbency of the clothes treated with it. As the result, it was found that the object is achieved by using in combination with a linear alkyl quaternary ammonium salt and a specific methyl-branched alkyl quaternary ammonium salt in a specific ratio. The combination of the two compounds produces a good softening effect without impairing the water absorbency of clothes unlike $\alpha$- or $\beta$-branched alkyl quaternary ammonium salt. The present invention was accomplished based on this finding.

Accordingly, it is an object of the present invention to provide a softener comprising:

(A) linear alkyl quaternary ammonium salt represented by the general formula (I) or (II):

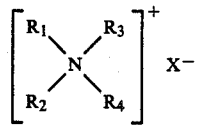

(I)

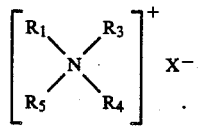

(II)

wherein $R_1$ and $R_2$ independently represent an alkyl group, alkenyl group, or $\beta$-hydroxyalkyl group having 10 to 24 carbon atoms; $R_3$, $R_4$, and $R_5$ independently represent an alkyl group or hydroxyalkyl group having 1 to 3 carbon atoms, a benzyl group, or $-(C_2H_4O)_{n1}H$ in which $n_1$ is 1 to 3; and X represents a halogen atom or monoalkyl sulfate group having an alkyl group having 1 to 3 carbon atoms; and (B) methyl-branched alkyl quaternary ammonium salt represented by the general formula (III) or (IV):

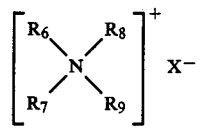

(III)

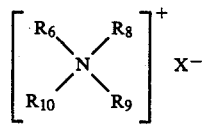

(IV)

wherein $R_6$ and $R_7$ independently represent

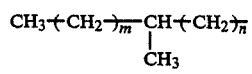

in which m is an integer of 2 to 14, n is an integer of 3 to 11, and the sum of m and n is an integer of 9 to 20; $R_8$, $R_9$, and $R_{10}$ independently represent an alkyl group or hydroxyalkyl group having 1 to 3 carbon atoms, a benzyl group, $-(C_2H_4O)_kH$, or $-(C_3H_6O)_lH$ in which k and l independently represent an integer of 1 to 3; and X represents a halogen atom, monoalkyl sulfate group having an alkyl group having 1 to 3 carbon atoms, or protonic acid residue, the ratio of (A) to (B) being 70/30 to 10/90 by weight.

DETAILED DESCRIPTION OF THE INVENTION AND PREFERRED EMBODIMENTS

Examples of component (A) include dilauryldimethylammonium chloride, dipalmityldimethylammonium chloride, distearyldimethylammonium chloride, di(hydrogenated beef tallow alkyl)dimethylammonium chloride, di(hydrogenated beef tallow alkyl)dimethylammonium methylsulfate, di(β-dihydroxystearyl)methylhydroxyethylammonium acetate, dioleyldiethylammonium ethylsufate, distearylmethylhydroxyethylammonium chloride, distearylmethylpolyoxyethylene ($\bar{p}$=3) ammonium chloride, and ditetracosyldimethylammonium chloride.

Preferred examples of component (B) are those which are represented by formulae (III) and (IV) in which $R_6$ and $R_7$ are methyl-branched alkyl groups having 15 to 21 carbon atoms, and more preferably, those methyl-branched alkyl groups having 18 carbon atoms account for more tha 60% in all the methyl-branched alkyl groups, and m is 6 to 8.

Among the counter anions represented by $X^-$, the protonic acid residue includes the following, which are not limitative though.

$C_iH_{2i+1}COO^{\ominus}$
$C_jH_{2j+1}OPO_3^{\ominus}$
$HOCH_2COO^{\ominus}$

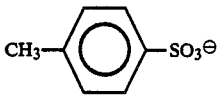

wherein i and j denote a numeral of 0 to 17 and a numeral of 8 to 18, respectively.

Component (B) used in this invention is characterized by the branching condition and the branching position as shown in the general formula below.

$$CH_3\text{-}(CH_2)_m\text{-}\underset{\underset{CH_3}{|}}{CH}\text{-}(CH_2)_n$$

wherein m and n denote an integer of 2 to 14 and an integer of 3 to 11, respectively, and the sum of m and n is an integer of 9 to 20. It is to be noted that the branching position of the methyl group is near the center of the alkyl group and there is no branched methyl group at the α- and β-positions at all. As will be proved in the examples given later, the effect of the invention results form the unique branching position of the methyl group.

According to this invention, component (A) and component (B) should be incorporated in a ratio of from 70/30 to 10/90, preferably from 50/50 to 20/80 by weight. With a ratio outside this range, the resulting composition is not satisfactory in softness and water absorbency. If component (A) is combined with an α-branched or β-branched alkyl quaternary ammonium salt instead of component (B), the resulting composition is improved in water absorbency but is poor in softness.

The softener of this invention can be incorporated with any known cationic softener base in an amount which does not weaken the effect of the invention. Examples of such cationic softener base include the following.

(a) amide ammonium salts having in the molecule one or two $C_{10}$–$C_{24}$ alkyl groups, alkenyl groups, or β-hydroxyalkyl groups, represented by the following formulas (1) to (4).

$$R_{13}CONH\text{-}(CH_2)_q\text{-}\overset{\overset{R_{11}}{|}}{\underset{\underset{R_{12}}{|}}{N^+}}\text{-}(CH_2)_q\text{-}N\begin{matrix}R_{15}\\R_{16}\end{matrix}\quad X^- \tag{1}$$

$$R_{13}CONH\text{-}(CH_2)_q\text{-}\overset{\overset{COR_{14}}{|}}{\underset{\underset{R_{11}}{|}}{N^+}}\text{-}(CH_2)_q\text{-}N\begin{matrix}R_{15}\\R_{16}\end{matrix}\quad X^- \tag{2}$$

$$R_{13}CONH\text{-}(CH_2)_q\text{-}\overset{\overset{R_{11}}{|}}{\underset{\underset{R_{12}}{|}}{N^+}}\text{-}(CH_2)_q\text{-}NHCOR_{14}\ X^- \tag{3}$$

$$R_{13}CONH\text{-}(CH_2)_q\text{-}\overset{\overset{COR_{14}}{|}}{N}\text{-}(CH_2)_q\text{-}\overset{\overset{R_{11}}{|}}{\underset{\underset{R_{15}}{|}}{N^+}}\text{-}R_{12}\ X^- \tag{4}$$

wherein $R_{13}$ and $R_{14}$ independently represent $C_{10}$–$C_{24}$ alkyl group, alkenyl group, or β-hydroxyalkyl group; $R_{11}$, $R_{12}$, $R_{15}$, and $R_{16}$ independently represent a hydrogen atom, $C_1$–$C_3$ alkyl group or hydroxyalkyl group, benzyl group, or $-(C_2H_4O)_{\bar{p}}H$ (p=1 to 3); q is a numeral of 2 or 3; and X is a halogen atom or a monoalkyl sulfate group having a $C_1$–$C_3$ alkyl group.

(b) Imidazolium salts represented by general formula (5) below.

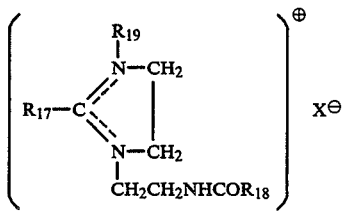

(5)

wherein $R_{17}$ and $R_{18}$ independently represent a $C_{10}$–$C_{24}$ alkyl group, alkenyl group, or β-hydroxyalkyl group; $R_{19}$ represents a $C_1$–$C_3$ alkyl group or hydroxyalkyl group, benzyl group, or $-(C_2H_4O)_{\bar{k}}H$ (k=1 to 3) or $-(C_3H_6O)_{\bar{l}}H$, (l=1 to 3); and X is a halogen atom or a monoalkyl sulfate group having a $C_1$–$C_3$ alkyl group.

If the cationic softener is incorporated in an excessive amount, the resulting softener will not fully exhibit the softness and water absorbency intended in this invention.

The softener of this invention may be produced in various forms, e.g., liquid, powder, spray (aerosol), and impregnated cloth, nonwoven cloth, and paper towel, according to the intended usage. The amount of the softener base in the softener formulation varies depending on the type of the formulation; and it is usually more than 3 wt%, and preferably 3 to 70 wt%.

The softener of this invention may be incorporated with any of the following compounds, in addition to the above-mentioned cationic softener base, according to the intended form and the performance required.

(a) Amines:

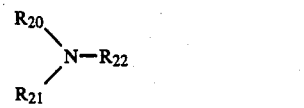

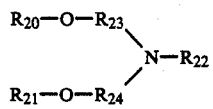

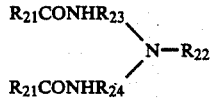

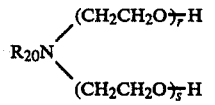

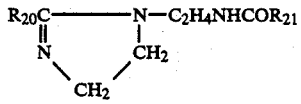

wherein $R_{20}$ denotes a $C_8$–$C_{24}$ saturated or unsaturated linear or branched alkyl group or a $C_8$–$C_{24}$ secondary alkanol group; $R_{22}$ denotes a $C_1$–$C_3$ alkyl group or hydroxyalkyl group or $-(CH_2CH_2O)_tH$ in which t is a numeral of 1 to 10; $R_{23}$ and $R_{24}$ independently denote a $C_1$–$C_3$ alkylene group or $-(CH_2CH_2O)_uH$ in which u is a numeral of 1 to 10; r and s each denote a numeral of 1 to 10; and $R_{21}$ denotes the same group as $R_{20}$ or $R_{21}$.

(b) Nonionic surface active agents:

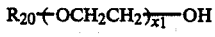

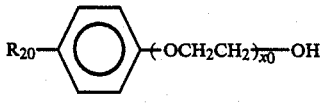

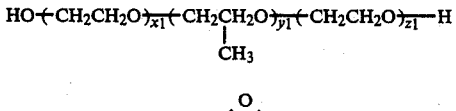

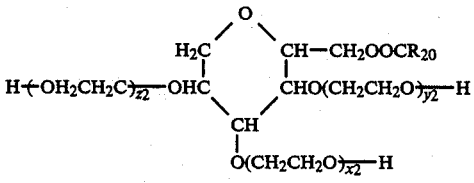

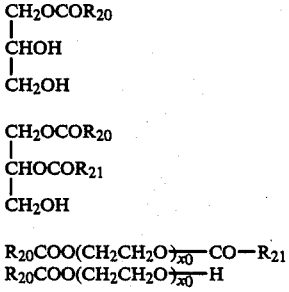

wherein $X_0$ is a numeral of 1 to 100; $x_1$, $y_1$, and $z_1$ are numerals which satisfy $x_1+y_1+z_1=100$; and $x_2$, $y_2$, and $z_2$ each denote a numeral of 0 to 100; and $R_{20}$ and $R_{21}$ have the same meanings as defined above.

(c) Fatty acids:

$R_{20}COOH$ wherein $R_{20}$ has the same meaning as defined above.

(d) Anionic surface active agents:

Fatty acids salts sodium alkylbenzenesulfonate, alkyl sulfate ester salt, alkylnaphthalene sulfonate, alkyl phosphate, and the like.

(e) Amphoteric surface active agents:

Alkyldimethylaminoacetic acid betaine, alkylcarboxymethylhydroxyethyl imidazolium betaine, and the like.

(f) Water-soluble salts:

Sodium chloride, ammonium chloride, calcium chloride, etc.

(g) Solvents:

Propylene glycol, ethylene glycol, etc.

Furthermore, the softener of this invention may be incorporated, in addition to the above-mentioned components, with urea, bactericide, antioxidant, pigment or dye which improves the appearance of the product, fluorescent whitening agent which can impart whiteness to clothes, and perfume which acts as a fragrance at the time of use and after finishing.

The softener of this invention imparts softness and antistatic property to a variety of fibers without impairing the water absorbency. This effect was not expected in view of the fact that if a linear alkyl quaternary ammonium salt is incorporated with an α- or β-branched alkyl quaternary ammonium salt, the resulting softener is good in water absorbency but poor in softness. The methyl-branched alkyl quaternary ammonium salt, which is one component of the softener of this invention, is chemically stable because it contains no double bond or ester linkage. In addition, it is easy to handle (e.g., to dissolve and emulsify at low temperatures) owing to its low melting point. This makes it possible to easily produce softener of this invention in the form of liquid.

The invention is now described with reference to the following examples.

PRODUCTION EXAMPLE 1

Synthesis of methyl-branched diisostearyldimethylammonium chloride (a) Synthesis of methyl-branched isostearylnitrile Methyl-branched isostearic acid (Emersol 875, a product of Emery Industries, Inc. in U.S.A.) was distilled under reduced pressure and the forerun (40%) and residue (10%) were removed. The thus obtained fatty acid was methyl-esterified with diazomethane and then subjected to the analysis by gas chromatography. According to the analytical result, the ester is composed of 90% of the compound having 18 carbon atoms in total and 10% of the compound having 16 carbon atoms in total, and that the branched methyl group is near the center of the alkyl main chain.

500 g of the fatty acid obtained above and 5 g of zinc oxide were placed in a 1-liter four-necked flask equipped with a stirrer, thermometer, dehydrating tube, and gas introducing tube. The contents were heated to 150° C. under a flow of a small amount of nitrogen gas. Then, ammonia was introduced at a rate of 60 liter/hour and the contents were heated up to 300° C. After the reaction was carried out for 5 hours at this temperature, the reaction product was cooled under the nitrogen steam and discharged. The product was distilled under reduced pressure (0.1 mmHg) at a bottom temperature of 150° to 220° C., to obtain 420 g (about 90% yields) of isostearylnitrile.

(b) Synthesis of methyl-branched diisostearylamine 300 g of the methyl-branched isostearylnitrile obtained in the above-mentioned process and Raney nickel (3 g as nickel) were placed in a 1-liter autoclave equipped with a magnetic stirrer. After the atmosphere in the autoclave was replaced with nitrogen twice, hydrogen was forced into the autoclave at a pressure of 20 kg/cm$^2$G. The reaction was carried out for 3 hours with heating at 220° C. and stirring. Ammonium formed by the reaction was removed by continuously blowing hydrogen while keeping the pressure. Upon analysis, the reaction product was found to contain 92% of secondary amine, 2% of primary amine, and 3% of tertiary amine.

(c) Synthesis of methyl-branched diisostearyldimethylammonium chloride

In a 1-liter autoclave equipped with a magnetic stirrer were placed 300 g of the methyl-branched diisostearylamine obtained in the above step (b), 83.2 g of isopropyl alcohol, 26.3 g of water, and 18.1 g of soda ash, and finally 43.1 g of methyl chloride was forced in. The contents were heated to 100° C. with stirring, and the reaction was carried out for about 7 hours. After the reaction was completed, the autoclave was cooled to 70° C. Excess methyl chloride was discharged by blowing and sodium chloride formed as a by-product was filtered out to obtain about 403 g of 75% solution of methyl-branched diisostearyldimethylammonium chloride.

PRODUCTION EXAMPLE 2

Synthesis of methyl-branched diisopalmityldimethylammonium chloride

Methyl-branched diisopalmityldimethylammonium chloride was synthesized from methyl-branched isopalmitic acid* in the same manner as in Production Example 1.

*The methyl-branched isopalmitic acid: A liquid obtained by the distillation of Emersol 875 (a product of Emery Industries, Inc. in U.S.A.) in which the forerun (10%) was removed and the subsequent fraction (10%) was subjected to fractional crystallization. According to the analysis by gas chromatography after methylesterification, it is composed of 83% of the compound having 16 carbon atoms and 17% of the compound having 18 carbon atoms, and that the branched methyl group is near the center of the alkyl main chain.

EXAMPLE 1

Formulation:

| | |
|---|---|
| Distearyldimethylammonium chloride [Component (A)] | Mixing ratio of (A)/(B) is shown in Table 1. The total amount of (A) and (B) is 6%. |
| Methyl-branched diisostearyldimethylammonium chloride [Component (B)] produced in Production Example 1 | |
| Water | Balance |

The performance of the softener of the above formulation was evaluated by examining the treated cloth for softness and water absorbency.

[Evaluation]

(1) Method for softening treatment

Commercial cotton towels or cotton knitted underclothes were washed five times with a commercial detergent ("Zab", a product of Kao Corporation). After rinsing out the detergent, they were dipped in a bath containing 0.1% of the softener in water (3.5° dH) at 25° C. for 5 minutes with stirring. The bath ratio was 1/30.

(2) Method of evaluation

The treated cloths were air-dried in the room and then allowed to stand for 24 hours in a thermohygrostatic chamber at 25° C. and 65% RH. The conditioned cloths were examined for softness and water absorbency.

(i) Softness

Control was prepared by treating the cloths with a softener containing no methyl-branched diisostearyldimethylammonium salt. The treated cloths were rated in comparison with control according to the following criteria.

+2 Softer than control
+1 Slightly softer than control
0 Identical with control
−1 Slightly harsher than control
−2 Harsher than control (ii) Water absorbency The cotton towels or cotton underclothes treated with the above-mentioned softener were cut into strips measuring 3 cm wide and 20 cm long. The strip was held vertically with its end (2 cm) dipped in water, and the water rise after 15 minutes was measured.

(3) Results

Table 1 shows the results of the evaluation of softness and water absorbency. It is noted that the softener is improved in water absorbency, with softness comparable to control, if component (A) [distearyldimethylammonium chloride] is incorporated with component (B) [methyl-branched diisostearyldimethylammonium chloride] at a ratio of 70/30 to 10/90 by weight.

TABLE 1

| | Cloths Treated | | | |
|---|---|---|---|---|
| | Cotton Towels | | Cotton Knitted Underclothes | |
| Ratio of (A)/(B) in softener by weight | Softness | Water Absorbency (cm) | Softness | Water Absorbency (cm) |
| Comparative Product 1 100/0 | Control | 6.1 | Control | 4.2 |
| Comparative Product 2 85/15 | 0 | 6.4 | 0 | 4.5 |
| Inventive Product 3 70/30 | 0 | 8.8 | 0 | 7.2 |
| Inventive Product 4 50/50 | 0 | 10.2 | 0 | 9.1 |
| Inventive Product 5 30/70 | 0 | 12.5 | 0 | 10.6 |
| Inventive Product 6 10/90 | 0 | 12.7 | 0 | 10.5 |
| Comparative Product 3 0/100 | −1 | 12.7 | −1 | 10.6 |
| Untreated | — | 12.7 | — | 10.6 |

EXAMPLE 2

Formulation:

| | |
|---|---|
| Hydrogenated tallow alkyltrimethylammonium chloride | 2 parts |
| Methyl-branched alkyltrimethylammonium chloride (as shown in Table 2) | 6 parts |
| Water | Balance |

Cotton knitted underclothes were treated with the softener of the above formulation and the treated underclothes were examined for softness and water absorbency in the same manner as in Example 1. The evaluation of softness was performed in comparison with Comparative Product 4 as control. The results are shown in Table 2.

TABLE 2

| | Methyl-branched alkyltrimethylammonium chloride $R_1N^+(CH_3)_2CH_3\ Cl^-$ | | Softness | Water Absorbency (cm) |
|---|---|---|---|---|
| Inventive Product 7 | $R_1$; Methyl-branched type isostearyl group (derived from the fatty acid used in Production Example 1) | | 0 | 10.5 |
| Inventive Product 8 | $R_1$; Methyl-branched isopalmityl group (derived from the fatty acid used in Production Example 2) | | 0 | 10.7 |
| Comparative Example 4 (Control) | Hydrogenated tallow alkyltrimethylammonium chloride | 8 parts | Control | 6.2 |
| | Water | Balance | | |

EXAMPLE 3

Formulation

| | |
|---|---|
| Di(hydrogenated tallow alkyl)dimethylammonium chloride | 1.5 parts |
| Di-branched alkyldimethylammonium chloride (as shown in Table 3) | 4.5 parts |
| Water | Balance |

Cotton knitted underclothes were treated with the softener of the above formulation and the treated underclothes were examined for softness and water absorbency in the same manner as in Example 1. The evaluation of softness was performed in comparison with Comparative Product 7 as control. The results are shown in Table 3.

TABLE 3

| | Di-branched alkyldimethylammonium chloride $R_2N^+(CH_3)_2CH_3\ Cl^-$ | | Softness | Water Absorbency (cm) |
|---|---|---|---|---|
| Inventive Product 9 | $R_2$; Methyl-branched type isostearyl group (prepared in Production Example 1) | | 0 | 10.5 |
| Inventive Product 10 | $R_2$; Methyl-branched isopalmityl group (prepared in Production Example 2) | | −0.5 | 10.6 |
| Comparative Product 5 | $R_2$; 2-methyl-myristyl group | | −0.5 | 8.2 |
| Comparative Product 6 | $R_2$; $-CH_2-CH(C_9H_{19})-C_7H_{15}$ | | −2.0 | 10.5 |
| Comparative Product 7 (Control) | Di(hydrogenated tallow alkyl)-dimethylammonium chloride | 6 parts | Control | 4.3 |
| | Water | Balance | | |

EXAMPLE 4

Formulation:

| | |
|---|---|
| Quaternary ammonium chloride as shown in Table 4 | 6 parts (in total) |
| Polyoxyethylene lauryl ether (with 6.5 mole (on average) of ethylene added) | 1 part |
| Ethylene glycol | 4 parts |
| Perfume and dye | small amount |
| Water | Balance |

Cotton knitted underclothes were treated with the softener of the above formulation and the treated underclothes were examined for softness and water absorbency in the same manner as in Example 1. The evaluation of softness was performed in comparison with Comparative Product 9 as control. The results are shown in Table 4.

TABLE 4

| | Di-branched alkyldimethyl-ammonium chloride 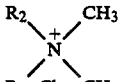 | | Softness | Water Absorbency (cm) |
|---|---|---|---|---|
| Inventive Product 11 | One derived from hydrogenated tallow fatty acid | 1.2 parts | 0 | 9.8 |
| | One derived from methyl-branched isostearic acid (Emersol 875, a product of Emery Industries, Inc. in U.S.A.) | 4.8 parts | | |
| Comparative Product 8 | One derived from hydrogenated tallow fatty acid | 6 parts | −1.0 | 7.0 |
| Comparative Product 9 (Control) | One derived from hydrogenated tallow fatty acid | 6 parts | Control | 4.3 |
| Comparative Product 10 | One derived from synthetic alcohol (Dovernol 45, a product of Mitsubishiyuka, Inc.) having 14 to 15 carbon atoms and also having a methyl branch at -position | 6 parts | −2.0 | 10.4 |

What is claimed is:

1. A softener comprising:

(A) a linear alkyl quaternary ammonium salt represented by the formulas (I) or (II):

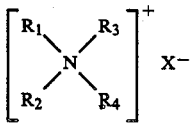

(I)

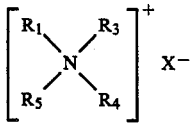

(II)

wherein $R_1$ and $R_2$ independently represent an alkyl group, alkenyl group, or β-hydroxyalkyl group having 10 to 24 carbon atoms; $R_3$, $R_4$, and $R_5$ independently represent an alkyl group or hydroxyalkyl group having 1 to 3 carbon atoms, a benzyl group, or $-(C_2H_4O)_{n_1}H$ in which $n_1$ is 1 to 3; and X represents a halogen atom or monoalkyl sulfate group having an alkyl group having 1 to 3 carbon atoms; and (B) a methyl-branched alkyl quaternary ammonium salt represented by the formulas (III) or (IV):

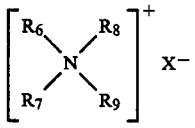

(III)

-continued

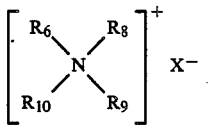

(IV)

wherein $R_6$ and $R_7$ independently represent $$CH_3-(CH_2)_m-\underset{\underset{CH_3}{|}}{CH}-(CH_2)_n$$

in which m is an integer of 2 to 14, n is an integer of 3 to 11, and the sum of m and n is an integer of 9 to 20; $R_8$, $R_9$, and $R_{10}$ independently represent an alkyl group or hydroxyalkyl group having 1 to 3 carbon atoms, a benzyl group, $-(C_2H_4O)_kH$, or $-(C_3H_6O)_lH$ in which k and l independently represent an integer of 1 to 3; and X represents a counter anion, the ratio of (A) to (B) being 70/30 to 10/90 by weight.

2. The softener according to claim 1, wherein said counter anion $X^-$ is an ion selected from the group consisting of $C_iH_{2i+1}COO^-$, $C_jH_{2j+1}OPO_3^-$, wherein i and j respectively range from 0 to 17 and 8 to 18, $HOCH_2COO^-$ and p-tolyl sulfonate.

3. The softener according to claim 1, wherein the ratio of component (A) to component (B) ranges from 50/50 to 20/80.

4. The softener according to claim 1, which further comprises a cationic softener base which is a member selected from the group consisting of amide ammonium salts and imidazolium salts.

5. The softener according to claim 4, wherein the amount of said softener base in the softener formulation ranges from 3–70 wt.%.

6. The softener according to claim 4, which comprises, in addition to said softener base, at least one material selected from the group consisting of amines, nonionic surface active agents, fatty acids, anionic surface active agents, amphoteric surface active agents, water-soluble salts and solvents.

* * * * *